US006824945B2

(12) United States Patent
Emoto et al.

(10) Patent No.: US 6,824,945 B2
(45) Date of Patent: Nov. 30, 2004

(54) ELECTROPHOTOGRAPHIC TONER

(75) Inventors: Shigeru Emoto, Shizuoka-ken (JP); Masami Tomita, Shizuoka-ken (JP); Hiroshi Yamashita, Shizuoka-ken (JP); Tsunemi Sugiyama, Shizuoka-ken (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/250,667

(22) PCT Filed: Jan. 7, 2002

(86) PCT No.: PCT/JP02/00011

§ 371 (c)(1),
(2), (4) Date: Jul. 7, 2003

(87) PCT Pub. No.: WO02/056116

PCT Pub. Date: Jul. 18, 2002

(65) Prior Publication Data

US 2004/0053155 A1 Mar. 18, 2004

(30) Foreign Application Priority Data

Jan. 5, 2001 (JP) ..... 2001-000743

(51) Int. Cl.[7] ..... G03G 13/08

(52) U.S. Cl. ..... 430/137.15; 430/109.4; 430/110.3; 430/137.17

(58) Field of Search ..... 430/137.15, 109.4, 430/110.3, 137.17, 109.1

(56) References Cited

U.S. PATENT DOCUMENTS 6,326,115 B1 * 12/2001 Nakanishi et al. ..... 430/109.5
6,365,315 B1 * 4/2002 Wulf et al. ..... 524/474
6,682,866 B2 * 1/2004 Sugiyama et al. ..... 430/108.1

FOREIGN PATENT DOCUMENTS

| | | |
|---|---|---|
| JP | 3-15861 | 1/1991 |
| JP | 2000-250265 | 9/2000 |

* cited by examiner

*Primary Examiner*—John L Goodrow
(74) *Attorney, Agent, or Firm*—Oblon, Spivak, McClelland, Maier & Neustadt, P.C.

(57) ABSTRACT

Disclosed is an electrophotographic toner using a polyester resin as a binder and a highly dispersed pigment colorant. The toner gives a high quality image excellent in transparency and chroma (brightness, gloss) and exhibits excellent powder fluidity, anti-offset property, charge stability and transferability.

The toner is obtained by dispersing an oil dispersion, containing an isocyanate group-containing polyester prepolymer dissolved in an organic solvent, a pigment colorant dispersed therein and a releasing agent dissolved or dispersed therein, in an aqueous medium in the presence of inorganic fine particles and/or polymer fine particles, reacting the prepolymer in the dispersion with a polyamine and/or a monoamine containing an active hydrogen-containing group to form an urea-modified polyester resin having an urea group, and by removing the liquid medium from the dispersion containing the urea-modified polyester resin, and is characterized in that the pigment colorant contained in the toner has a dispersion diameter, in terms of a number average diameter, of 0.5 $\mu$m or less and in that particles of the pigment colorant having a diameter of 0.7 $\mu$m or more account for 5% by number or 30 less.

14 Claims, No Drawings

ELECTROPHOTOGRAPHIC TONER

TECHNICAL FIELD

The present invention relates to an electrophotographic toner for developing an electrostatic image formed on a photoconductor surface in electrophotography, electrostatic recording or electrostatic printing, to a developer using the above toner, to a developing method using the toner, to a developing device using the toner, to a toner container containing the toner and to a developer container containing the developer.

BACKGROUND ART

Methods for visualize image information through electrostatic latent images by using an image forming device utilizing electrophotography or electrostatic recording are now utilized in a variety of fields. In the electrophotography, for example, image information is formed into an electrostatic latent image on a photoconductor through an exposing step following a charging step. The latent image is developed by a developer. Through succeeding transferring and fixing steps, the image information is reproduced. In this case, the developer may be a single component developer using a magnetic toner or a non-magnetic toner by itself or a two-component developer composed of a toner and a carrier.

The electrophotographic toner used for such a developer is generally produced by a kneading and grinding method in which a thermoplastic resin is melted and kneaded together with a pigment and, if necessary, a releasing agent and a charge controlling agent and, followed by fine pulverization and classification. The thus obtained toner is, if desired, added on surfaces thereof with inorganic or organic fine particles for the purpose of improving fluidity and cleaning property.

A toner obtainable by the conventional kneading and grinding method generally is irregular in shape and broad in particle size distribution and, thus, has problems that the fluidity is low, the transferability is low, the fixation energy required is high, the charge amount between particles is not uniform and the charging stability is low. Further, the quality of images obtained using such a toner is still unsatisfactory.

To overcome the problems of the above-described toner prepared by the kneading and grinding method, a method is proposed for preparing a toner by a polymerization method. Since this method does not include a grinding step, the toner can be produced without need of kneading and grinding steps. Therefore, this method contributes much to saving of energy consumption, reduction of process time, improvement in product yield and reduction of costs. Further, the particle size distribution of the polymerized toner particles obtained by the polymerization method is more easily adjusted to sharp distribution as compared with the grinding method. Additionally, the fluidity of the toner may be greatly improved and spherical toner may be easily obtained.

The toner produced by the polymerization method still has a number of problems to be solved. During the polymerization stage in the production of the toner by the polymerization method, surface tensions are exerted so that the sphericity of the particles is higher than that obtained by the kneading and grinding method. On the other hand, the characteristics of the toner are not fully satisfactory. Further, it is not easy to control the shape (irregularization of the shape) of the toner by the polymerization method. However, the toner is advantageous in charging stability and in transferability.

In a method of preparation of a toner by a suspension polymerization method which is widely adopted among various polymerization method, a monomer for the binder is predominantly a styrene monomer or an acrylic monomer which are harmful for human bodies. Since the toner obtained by this method inevitably contains these components, there is caused an environmental problem. Further, since the toner contains a wax, the deposition of the toner to a photoconductor during actual uses is reduced. However, since the wax is embedded in the toner, the wax is less easily exuded to the surfaces of the toner and, hence, the fixation efficiency is inferior as compared with the toner produced by the grinding method in which the wax is present on the surfaces of the particles. Therefore, the polymerized toner is disadvantageous with respect to the consumption of electric power. Further, when the amount of the wax of the polymerized toner used as a color toner is increased, or when the dispersion diameter of the wax is increased to improve the fixation efficiency, the transparency of the color image becomes worse so that the toner is ill-suited for use in the formation of images for presentation by OHP.

As a method of producing polymerized toner other than the suspension polymerization method, there is known an emulsion polymerization method which permits relatively easy control of the shape of the toner. In the emulsion polymerization too, the monomer is limited to a styrene monomer. Further, with this method, too, it is difficult to completely remove unreacted monomer components from the toner particles or to completely remove an emulsifying agent and a dispersing agent from the toner particles, so that an environmental problem by toner tends to occur.

A solution suspension method is known as a method of producing a toner. This method has a merit that it is possible to use a polyester resin which permits low temperature fixation. With this method, however, problems in productivity attributed to an increase of the viscosity of liquid are caused because a high molecular weight component is added in a step of dissolving or dispersing a resin with low temperature fixation property or a colorant in a solvent. In addition, for the purpose of improving cleaning property of the toner obtained by the solution suspension method, the toner is made spherical and the surface thereof is made uneven (Japanese Laid-Open Patent Publications No. H09-015903). Because of the irregular non-uniform shape, the toner is lacking in charge stability and has a problem in durability and releasability and, therefore, satisfactory toner quality is not obtainable.

Japanese Laid-Open Patent Publication No. H11-133665 discloses a dry toner having a practical sphericity of 0.90–1.00 and using a chain-extended, urethane-modified polyester as a toner binder for the purpose of improving toner fluidity, low temperature fixation property and anti-offset property. Japanese Laid-Open Patent Publications No. H11-149179 and 2000-292981 disclose a dry toner having excellent powder fluidity and transferability when formed into a small diameter toner and are also excellent in heat resistant preservability, low temperature fixing property and anti-hot offset property. The method of preparing the toner disclosed in these publications include a step of increasing molecular weight by condensation addition of an isocyanate group-containing polyester prepolymer with an amine in an aqueous medium.

The polymerized toner obtained by the above-described polymerization methods, the colorant is non-uniformly dispersed because of poor dispersibility thereof. Therefore, the image obtained by the toner has a problem that the transparency is low and the chroma (brightness) is inferior. In particular, there is caused a drawback that the image is dark when the toner is used to form a color image on an OHP sheet.

It is an objective problem of the present invention to provide an electrophotographic toner which uses a polyester resin as a binder, in which a pigment colorant is highly dispersed, which gives a high quality image excellent in transparency and chroma (brightness, gloss) and which exhibits excellent powder fluidity, anti-offset property, charge stability and transferability. The present invention is also aimed at the provision of a developer using the above toner, a developing method using the toner, a developing device using the toner, a toner container containing the toner and a developer container containing the developer.

DISCLOSURE OF THE INVENTION

The present inventors have made an earnest study with a view toward solving the above-described problems and, as a result, have completed the present invention.

Thus, in accordance with the present invention, there are provided a toner, a developer, a developing method, a developing device, a toner container and a developer container as follows:

(1) An electrophotographic toner obtained by dispersing an oil dispersion, containing an isocyanate group-containing polyester prepolymer dissolved in an organic solvent, a pigment colorant dispersed therein and a releasing agent dissolved or dispersed therein, in an aqueous medium in the presence of inorganic fine particles and/or polymer fine particles, reacting said prepolymer in said dispersion with a polyamine and/or a monoamine containing an active hydrogen-containing group to form an urea-modified polyester resin having an urea group, and by removing the liquid medium from the dispersion containing the urea-modified polyester resin, characterized in that said pigment colorant contained in the toner has a dispersion diameter, in terms of a number average diameter, of 0.5 $\mu$m or less and in that particles of said pigment colorant having a diameter of 0.7 $\mu$m or more account for 5% by number or less.

(2) A toner as recited in (1) above, characterized in that said pigment colorant has a dispersion diameter, in terms of a number average diameter, of 0.3 $\mu$m or less and in that particles of said pigment colorant having a diameter of 0.5 $\mu$m or more account for 10% by number or 10 less.

(3) A toner as recited in (1) or (2) above, characterized in that the toner has a weight average particle diameter of 3.0 to 7.0 $\mu$m and such a particle diameter distribution that the ratio Dv/Dn (Dv: a volume average particle diameter, Dn: a number average particle diameter) is not smaller than 1.00 but not greater than 1.20.

(4) A toner as recited in any one of (1) to (3) above, characterized in that the toner has a sphericity of 0.900 to 0.960.

(5) A toner as recited in any one of (1) to (4) above, characterized in that tetrahydrofuran soluble components of the polyester resin contained in the toner has such a molecular weight distribution that a main peak is present in a molecular weight region of 2,500 to 10,000 and that the number average molecular weight thereof is in the range of 2,500 to 500,000.

(6) A toner as recited in any one of (1) to (5) above, characterized in that the polyester resin contained in the toner has a glass transition temperature of 40 to 65° C. and an acid value of 1 to 30 mgKOH/g.

(7) A toner as recited in any one of (1) to (6) above, characterized in that said oil dispersion comprises a polyester resin dissolved therein and being non-reactive with said amine.

(8) A developer characterized in that the developer comprises a toner as recited in any one of (1) to (7) above, and a carrier.

(9) A toner container characterized in that the container comprises packed therein a toner as recited in any one of (1) to (7) above.

(10) A developer container characterized in that the container comprises packed therein a developer as recited in (8) above.

(11) A developing method characterized in that a toner as recited in any one of (1) to (7) above is used.

(12) A developing device characterized in that a toner as recited in any one of (1) to (7) above is used.

(13) A developing device characterized in that a toner contained in the toner container as recited in (9) above is used.

(14) A developing device characterized in that a developer contained in the developer container as recited in (10) above is used.

It is without saying that the toner according to the present invention is applicable as a monocolor toner and a color toner.

BEST MODE FOR CARRYING OUT THE INVENTION

A toner according to the present invention is obtainable by dispersing an oil dispersion, containing an isocyanate group-containing polyester prepolymer (A) dissolved in an organic solvent, a pigment colorant dispersed therein and a releasing agent dissolved or dispersed therein, in an aqueous medium in the presence of inorganic fine particles and/or polymer fine particles, reacting the prepolymer (A) in the dispersion with a polyamine and/or a monoamine (B) containing an active hydrogen-containing group to form an urea-modified polyester resin (C) having an urea group, and by removing the liquid medium from the dispersion containing the urea-modified polyester resin (C). The urea-modified polyester resin (C) has a Tg of 40 to 65° C., preferably 45 to 60° C., a number average molecular weight Mn of 2,500 to 50,000, preferably 2,500 to 30,000 and a weight average molecular weight Mw of 10,000 to 500,000, preferably 30,000 to 100,000.

The toner contains, as a binder resin, the urea-modified polyester resin (C) having a urea bond and an increased molecular weight by reaction of the prepolymer (A) with the amine (B). In the binder resin, the colorant is highly dispersed.

As a result of repeated earnest studies on the above toner, the present inventors have found that a toner which is excellent in low temperature fixation efficiency, in charging stability and in fluidity, which gives a high quality image, in particular, excellent transparency and gloss, can be obtained by adjusting the dispersion diameter of the pigment colorant contained in the toner to 0.5 $\mu$m or less in terms of a number average diameter, and by suppressing the amount of particles of said pigment colorant having a diameter of 0.7 $\mu$m or more to 5% by number or less.

Further studies by the present inventors have revealed that a toner having still higher quality may be obtained by adjusting the dispersion diameter of the pigment colorant contained in the toner to 0.3 $\mu$m or less in terms of a number average diameter, and by suppressing the amount of particles of said pigment colorant having a diameter of 0.5 $\mu$m or more to 10% by number or less. Such a toner has excellent image resolving power and is suited for use as a toner for a developing device of a digital mode. In particular, with the color toner according to the present invention, a high quality color image having excellent resolution, transparency and color reproducibility may be obtained.

In order to obtain the above-described toner according to the present invention in which the colorant is uniformly dispersed, it is necessary to contrive the conditions under which the toner is prepared. Under the conventional preparation condition, the high quality toner as described above cannot be obtained.

In the case of the present invention, it is necessary to adopt a step of pulverizing the colorant (wet pulverization step) at a time of the formation of the oil dispersion containing the prepolymer (A), the colorant and the releasing agent in order to obtain the above-described high quality toner. In this case, as a wet pulverizing device for carrying out the wet pulverization step, any device may be used as long as it can impart impact strengths to the colorant in a liquid and to finely pulverize the colorant. Such a device may be any conventionally known wet pulverizing device such as a ball mill or beads mill.

The wet pulverizing step may be carried out at a temperature of 5 to 20° C., preferably 15 to 20° C.

By controlling the conditions under which the wet pulverization is carried out, it is possible to control the dispersion particle diameter and the particle distribution of the colorant contained in the toner in the above-described ranges.

A similar wet pulverization step may be performed for the dispersion after the reaction, if necessary.

In the present invention, the above-described high quality toner may be obtained by a method in which master batch colorant particles obtained by dispersing the colorant in a resin at a high concentration are used as a colorant material and are added to and dispersed in an organic solvent with stirring. The use of such master batch particles permit the preparation of a toner in which the colorant having a small dispersion particle diameter is uniformly dispersed and which gives color images having good transparency.

The master batch colorant particles may be suitably prepared by kneading a mixture of a heat fusible resin and the colorant at a temperature of the melting temperature of the resin while applying high shearing strengths thereto. The kneaded mixture is cooled and solidified and the solidified product is pulverized.

As the resin, a thermoplastic resin having good miscibility with the urea-modified polyester resin (C) derived from the above-described prepolymer (A). In the case of the present invention, a polyester resin is preferably used. The thermoplastic resin has a softening point of 100 to 200° C., preferably 120 to 160° C., and a number average molecular weight Mn of 2,500 to 5,000, preferably 2,500 to 30,000.

The concentration of the colorant in the master batch colorant particles is 10 to 60% by weight, preferably 22 to 55% by weight.

Methods of measuring physical properties of the toner such as dispersion diameter of the pigment colorant in the toner will be next described in detail.

For the measurement of the dispersion diameter and particle size distribution of the pigment colorant in the toner, the toner is embedded in an epoxy resin and is sliced by Microtome MT6000-XL (Meiwa Shoji K. K.) into a thickness of about 100 nm to obtain a sample. The sliced sample is photographed with an electron microscope (H-9000NAR manufactured by Hitachi Ltd.) at a magnification of 10,000 to 40,000 with an acceleration voltage of 100 kV. The image is analyzed by an image analyzer LUZEX III and converted into image data. The above measurement is carried out for more than 300 arbitrary samples of the particles of the pigment colorant having a particle diameter of 0.1 μm or more, from which the average diameter and particle diameter distribution are determined.

The toner according to the present invention has a weight average particle diameter (Dv) of 3.0 to 7.0 μm and a ratio (Dv/Dn) of the weight average particle diameter to the number average particle diameter (Dn) is $1.00 \leqq Dv/Dn \leqq 1.20$. With the above-defined range of Dv/Dn, it is possible to obtain a toner having high resolution and high image quality. For reasons of obtaining higher image quality, it is also preferred that the weight average particle diameter (Dv) be in the range of 3 to 7 μm, that the Dv/Dn ratio be $1.00 \leqq Dv/Dn \leqq 1.20$ and that toner particles having a diameter of 3 μm or less account for 1 to 10% by number. It is more preferred that the weight average particle diameter (Dv) be in the range of 3 to 6 μm and that the Dv/Dn ratio be $1.00 \leqq Dv/Dn \leqq 1.15$. Such a toner exhibits excellent heat resistant preservability, low temperature fixation efficiency and anti-hot offsetting property. In particular, when the toner is used for a full color copying machine, the image has excellent gloss. Further, when the toner is applied to a two-component developer and even when the consumption and replenishment of the toner is performed for a long period of time, variation of the particle diameter of the toner of the developer is small. Additionally, even when the developer is agitated in a developing device for a long period of time, stable developing property is maintained.

It is generally said that smaller particle size of a toner is more advantageous for obtaining images with high resolution and high image quality. However, with respect to the transferability and cleaning property, small particle size is not advantageous. When, in the case of a two-component developer, the volume average particle size is less than the range specified in the present invention, the toner is apt to melt-adhered to surfaces of the carrier during a long time agitation in the developing device and to reduce the chargeability of the carrier. In the case of a single component developer, filming of a developer by the toner and melt-adhesion of the toner to a toner-thickness regulating member such as a blade are apt to occur. These phenomena are related largely to a content of fine powder in the toner. In particular, when the content of particles having a particle diameter of 3 μm or less exceeds 10%, the toner is not easily adhered to the carrier and it becomes difficult to obtain a high level of charge stability.

On the other hand, when the particle diameter of the toner is greater than the range specified in the present invention, it is difficult to obtain high resolution and high quality images. Further, when the consumption and replenishment of the toner is performed for a long period of time, variation of the particle diameter of the toner increases. Similar problems are also found to be caused when the ratio of the weight average particle diameter to the number average particle diameter is greater than 1.20.

The average diameter and particle diameter distribution of the toner are measured by the Coulter method. As a measuring instrument for the particle distribution of the toner particles, there may be mentioned Coulter Counter TA-II and Coulter Multisizer II (both manufactured by Coulter Electronics, Inc.). In the present invention, Coulter Counter TA-II is used to which an interface (manufactured by Nikkaki Inc.) capable of outputting number-based and volume-based distribution and a personal computer (PC9801 manufactured by NEC Inc.) are connected.

A method for the measurement of the number-based and volume-based distribution of the toner is described below. As an electrolytic solution for measurement, an aqueous 1% by weight NaCl solution of first-grade sodium chloride (such as ISOTON-II manufactured by Coulter Electronics, Inc.) is used. A dispersant (0.5–5 ml of a salt of alkylbenzenesulfonic acid) is added to 100 to 150 ml of the above electrolytic solution, to which 2 to 20 mg of a sample to be measured are added. The resulting electrolytic solution in which the sample is suspended is subjected to a dispersing treatment for about 1 to about 3 minutes in an ultrasonic dispersing machine. Using an aperture of 100 μm in the above particle size distribution measuring device, the number and volume of the toner particles are measured, from which volume particle distribution and number particle distribution are calculated.

In the measurement, 13 channels, i.e., 2.00–2.52 μm; 2.52–3.17 μm; 3.17–4.00 μm; 4.00–5.04 μm; 5.04–6.35 μm; 6.35–8.00 μm; 8.00–10.08 μm; 10.08–12.70 μm; 12.70–16.00 μm; 16.00–20.20 μm; 20.20–25.40 μm; 25.40–32.00 μm; and 32.00–40.30 μm (the upper limit not included), are used and particles having a diameter of not smaller than 2.00 μm and less than 40.30 μm are measured. From the weight average particle diameter (Dv) on the volume-basis determined from the volume distribution of the toner of the present invention and the number average particle diameter (Dn) determined from the number-based distribution, the ratio Dv/Dn is obtained.

With regard to anti-hot offset property of toners, various studies have been hitherto made including control of the molecular weight distribution of a binder resin. As a method of attaining both low temperature fixability and anti-hot offset property which are contradictory properties, there may be mentioned a method in which a binder resin having a wide molecular weight distribution is used and a method in which a mixed resin having a high molecular weight component having a molecular weight of several hundred thousands to several millions and a low molecular weight component having a molecular weight of several thousands to several ten thousands is used. Presence of a crosslinked structure or a gel of the high molecular weight component is more effective with respect to hot offset. In the case of a full color toner in which gloss and transparency are also required, however, use of a large amount of the high molecular weight component is not desirable. In the case of the present invention, the toner contains a high molecular weight urea-modified polyester resin having a urea bond, the anti-hot offset property can be achieved while ensuring the transparency and gloss.

The molecular weight distribution of a binder resin component contained in the toner of the present invention is measured by GPC as follows. A column is stabilized in a chamber heated to 40° C., through which THF is allowed to flow at a flowing speed of 1 ml/min. Then, 50 to 200 μl of a THF solution of a sample to be measured having a concentration of from 0.05 to 0.6% by weight, is injected into the column. Measurement of the molecular weight of the sample is then started.

The molecular weight distribution of the sample is calculated from the relationship between the logarithmic value and the count in the calibration curves of the standard single dispersion polystyrene resins. Polystyrenes having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ which are manufactured by Pressure Chemical Co., or Tosoh Corp. are exemplified as the standard polystyrenes for the preparation of the calibration curve. At least about ten standard polystyrenes are used. As a detector, RI (refractive index) detector is used.

The above-described binder component contained in the toner has generally such a molecular weight distribution that a main peak is present in a molecular weight region of 2,500 to 10,000, preferably 2,500 to 8,000, more preferably 2,500 to 6,000. An increase of the amount of the component having a molecular weight of less than 1,000 tends to adversely affect the heat resistant preservability. While an increase of the component having a molecular weight of 30,000 or more might tend to reduce the low temperature fixation efficiency, such a reduction can be suppressed by balance control. The content of the component having a molecular weight of 30,000 or more is 1% to 10%, preferably 3% to 6%, although the amount varies with the kind of the toner materials. An amount below 1% is insufficient to obtain satisfactory anti-hot offset property. When the amount exceeds 10%, on the other hand, the transparency is adversely affected.

The binder resin contained in the toner has Mn of 2,500 to 500,000 and Mw/Mn of 10 or less. When Mw/Mn exceeds 10, the sharp-melt property is lost to cause deterioration of the gloss.

The sphericity of the toner according to the present invention is measured using a flow particle image analyzer, "FPIA-2000", manufactured by SYSMEX Co., Ltd.).

The average sphericity of the toner according to the present invention is 0.900 to 0.960. It is important that the toner of the present invention should have a specific shape and specific shape distribution. A toner having an average sphericity of less than 0.900 has irregular shapes and fails to give a high quality image having satisfactory transferability and free of dispersed dots. Irregular-shaped toner particles can contact with a flat medium such as a photoconductor at an increased number of cites. Further, the charges are concentrated at tip portions of the protrusions of the particles. Thus, as compared with relatively spherical particles, the irregular-shaped particles provide a higher van der Waals force and a mirror image force. Therefore, in an electrostatic transferring step of a toner containing a mixture of irregular-shaped particles and spherical particles, the spherical particles are selectively transferred to cause image faults in letter and line pattern. Additionally, the toner particles remaining on the photoconductor must be removed for the next developing step to cause problems that a cleaning device must be provided and toner yield (proportion of the toner actually used to form images) is lowered. A ground toner generally has a sphericity of 0.910 to 0.920 when measured with the above device.

A suitable method of measuring the shape (sphericity) of the toner is an optical detection method in which a suspended liquid containing particles is allowed to pass through an image pickup zone provided on a flat plate to optically detect an image of particles with a CCD camera. With this method, projected areas of the particles may be obtained. The circularity may be calculated by dividing the circumferential length of a circle having same area as the projection area of a particle by the actual contour length of the particle. This value may be measured as an average sphericity determined using the flow particle image analyzer, "FPIA-2000". Concrete measuring method is as follows. Water (100 to 150 ml) in a container, from which solid impurities have been previously removed, is mixed with 0.1 to 0.5 ml of a surfactant (preferably a salt of alkylbenzenesulfonate). To the resulting solution, 0.1 to 0.5 g of a sample is added. This is subjected to a dispersion treatment for about 1 to 3 minutes with an ultrasonic disperser to form a sample dispersion liquid having a concentration of 3000 to 10000 particles/$\mu$l. The sample dispersion liquid is measured for the shape and shape distribution of the toner using the above analyzer.

A method of preparing a toner according to the present invention comprises a step of forming a high molecular weight material wherein an isocyanate group-containing polyester prepolymer (A) dispersed in an aqueous medium containing inorganic fine particles and/or polymer fine particles is reacted with an amine (B). In this case, the isocyanate group-containing polyester prepolymer (A) may be obtained by reacting a polyisocyanate (PIC) with an active hydrogen group-containing polyester prepared by polycondensation of a polyol (PO) with a polycarboxylic acid (PC). Examples of the active hydrogen group contained in the polyester include a hydroxyl group (alcoholic OH or phenolic OH), an amino group, a carboxyl group and a mercapto group. Above all, an alcoholic OH is preferred.

The polyol (PO) may be a diol (DIO) or a tri- or more polyhydric alcohol (TO). The use of a DIO or a mixture of a DIO with a minor amount of a TO is preferred.

Examples of the diol (DIO) include alkylene glycols such as ethylene glycol, 1,2-propylene glycol, 1,3-propylene glycol, 1,4-butanediol and 1,6-hexanediol; alkylene ether glycols such as diethylene glycol, triethylene glycol, dipropylene glycol, polyethylene glycol, polypropylene glycol and polytetramethylene ether glycol; alicyclic diols such as 1,4-cyclohexane dimethanol and hydrogenated bisphenol A; bisphenols such as bisphenol A, bisphenol F and bisphenol S; alkylene oxide adducts (e.g. ethylene oxide, propylene oxide and butylene oxide adducts) of the above alicyclic diols; and alkylene oxide adducts (e.g. ethylene oxide, propylene oxide and butylene oxide adducts) of the above bisphenols. Above all, alkylene glycols having 2–12 carbon atoms and alkylene oxide adducts of bisphenols are preferred. Especially preferred is the use of a mixture of an alkylene oxide adduct of a bisphenol with an alkylene glycol having 2–12 carbon atoms. Preferred examples of the tri- or more polyhydric alcohol (TO) include polyhydric aliphatic alcohols having 3–8 or more hydroxyl groups such as glycerin, trimethylolethane, trimethylolpropane, pentaerythritol, and sorbitol; tri- or more polyphenols such as trisphenol PA, phenol novolak and cresol novolak; and alkylene oxide adducts of the above tri- or more polyphenols.

The polycarboxylic acid (PC) may be a dicarboxylic acid (DIC), or a tri- or more polybasic carboxylic acid (TC). The use of a dicarboxylic acid or a mixture of a dicarboxylic acid with a minor amount of a tri- or more polybasic carboxylic acid is preferred. Examples of the dicarboxylic acid (DIO) include alkyldicarboxylic acids such as succinic acid, adipic and sebacic acid; alkenylene dicarboxylic acids such as maleic acid and fumaric acid; and aromatic dicarboxylic acids such as phthalic acid, isophthalic acid, terephthalic acid, and naphthalene dicarboxylic acid. Above all, alkenylene dicarboxylic acids having 4–20 carbon atoms and aromatic dicarboxylic acids having 8–20 carbon atoms are preferably used. Examples of the tri- or more polybasic carboxylic acid (TC) include aromatic polycarboxylic acids having 9–20 carbon atoms such as trimellitic acid and pyromellitic acid. The polycarboxylic acids (PC) may be in the form of anhydrides or lower alkyl esters (e.g. methyl esters, ethyl esters and isopropyl esters) and may be reacted with a polyol (PO).

The polyol (PO) and the polycarboxylic acid (PC) are used in such a proportion that the ratio [OH]/[COOH] of the equivalent of the hydroxyl groups [OH] to the equivalent of the carboxyl groups [COOH] is in the range of generally 2:1 to 1:1, preferably 1.5:1 to 1:1, more preferably 1.3:1 to 1.02:1.

Examples of the polyisocyanate (PIC) include aliphatic polyisocyanates such as tetramethylene diisocyanate, hexamethylene diisocyanate and 2,6-diisocyanate methylcaproate; alicyclic polyisocyanates such as isophorone diisocyanate, cyclohexylmethane diisocyanate; aromatic diisocyanate such as tolylene diisocyanate, diphenylmethane diisocyanate; araliphatic diisocyanates such as $\alpha,\alpha,\alpha',\alpha'$-tetramethylxylylene diisocyanate; isocyanurates; the above polyisocyanates blocked with phenol derivatives, oximes or caprolactams; and mixtures thereof.

In the preparation of the isocynate group-containing polyester prepolymer, the proportion of the polyisocyanate (PIC) and the active hydrogen-containing polyester (PE) is such that the ratio [NCO]/[OH] of the equivalent of the isocyanate groups [NCO] to the equivalent of the hydroxyl groups [OH] of the hydroxyl group-containing polyester is in the range of generally 5:1 to 1:1, preferably 4:1 to 1.2:1, more preferably 2.5:1 to 1.5:1. When the [NCO]/[OH] ratio is over 5:1, the low-temperature fixation properties of the resulting toner are adversely affected. When the mole ratio of [NCO] is less than 1, the urea content in the modified polyester will be low and the anti-hot offset properties of the resulting toner are adversely affected. The prepolymer (A) terminated with an isocyanate group-containing polyester has a content of the polyisocyate unit (PIC) in the range of generally 0.5–40% by weight, preferably 1–30% by weight, more preferably 2–20% by weight. Too small an isocyanate group content of less than 0.5% adversely affects the anti-hot offset properties of the resulting toner and poses a difficulty in simultaneously imparting satisfactory low-temperature fixation properties and heat resistive preservability to the resulting toner. When the isocyanate group content exceeds 40% by weight, the low-temperature fixation properties of the resulting toner are adversely affected.

The isocyanate group containing prepolymer (A) contains at least 1, preferably 1.5–3, more preferably 1.8–2.5 isocyanate groups per molecule. Too small the number of the isocyanate group of less than 1 per molecule will result in a urea-modified polyester having an excessively small molecular weight and the anti-hot offset properties of the resulting toner are adversely affected.

As the amine (B), there may be used a polyamine and/or a monoamine containing an active hydrogen-containing group. Examples of the amine include diamines (B1), tri- or more polyamines (B2), aminoalcohols (B3), aminomercaptans (B4), amino acids (B5) and blocked derivatives thereof (B6).

Illustrative of suitable diamines (B1) are aromatic diamines such as phenylenediamine, diethytoluenediamine and 4,4'-diaminodiphenylmethane; alicyclic diamines such as 4,4'-diamino-3,3-dimethylcyclohexylmethane, diaminocyclohexane and isophoronediamine; and aliphatic diamines such as ethylenediamine, tetramethylenediamine and hexamethylenediamine. Illustrative of suitable tri- or more polyamines (B2) are diethylenetriamine and triethylenetetramine. Illustrative of suitable aminoalcohols (B3) are ethanolamine and hydroxyethylaniline. Illustrative of suitable aminomercaptans (B4) are aminoethylmercaptan and aminopropylmercaptan. Illustrative of suitable amino acids (B5) are aminopropionic acid and aminocaproic acid. Illustrative of suitable blocked derivatives of the above amines (B6) ate ketimine compounds obtained by reacting the amines B1 to B5 with a ketone such as acetone, methyl ethyl ketone or methyl isobutyl ketone. Oxazolidine compounds may be also used as the blocked derivatives. Especially preferred is the use of B1 or a mixture of a B1 with a minor amount of a B2 as the amine (B).

In the reaction of the prepolymer (A) with the amine (B), a chain extension terminator may be used to control the molecular weight of the modified polyester, if desired. Examples of the chain extension terminator include monoamines such as diethylamine, dibutylamine, butylamine and laurylamine; and blocked monoamines such as ketimine compounds. The amount of the chain extension terminator used is suitably selected in relation with the molecular weight of the desired urea-modified polyester.

The proportion of amine (B) relative to the isocyanate group-containing prepolymer (A) is such that the ratio $[NCO]/[NH_x]$ of the equivalent of the isocyanate groups [NCO] of the isocyanate group-containing prepolymer (A) to the equivalent of the amino groups $[NH_x]$ of the amines (B) is in the range of generally 1:2 to 2:1, preferably 1.5:1 to 1:1.5, more preferably 1.2:1 to 1:1.2. A $[NCO]/[NH_x]$ ratio over 2:1 or less than 1:2 will result in a urea-modified polyester having an excessively small molecular weight and the anti-hot offset properties of the resulting toner are adversely affected.

In the present invention, the isocyanate group-containing prepolymer (A) is reacted with the amine (B) in an aqueous medium. If desired, a polyester resin (C) which is not reactive with the amine may be incorporated into the aqueous medium. The polyester resin (D) has Tg of 35 to 65° C., preferably 45 to 60° C. and Mn of 2,000 to 10,000, preferably 2,500 to 8,000. As the polyester (D), there may be used a urea-modified polyester (UMPE) which may contain an urethane bond in addition to an urea bond. The mole ratio of the urea bond content to the urethane bond content is generally 100/0 to 10/90, preferably 80/20 to 20/80, more preferably 60/40 to 30/70. When the mole ratio of the urea bond is less than 10%, the anti-hot offset properties of the resulting toner are adversely affected.

The urea-modified polyester (UMPE) may be prepared by a known method such as a one-shot method. The urea-modified polyester (UMPE) generally has a weight average molecular weight of at least 10,000, preferably 20,000 to 500,000, more preferably 30,000 to 100,000. Too small a weight average molecular weight of less than 10,000 adversely affects the anti-hot offset properties. The urea-modified polyester (UMPE) which is use as necessary is not only employed by itself but also employed in conjunction with an unmodified polyester (PE) as the toner binder. The conjoint use with (PE) is more preferable as compared with the use of (UMPE) by itself, because the low temperature fixation efficiency and the gloss when applied to a full color device are improved. As the PE, there may be mentioned polycbndensation products obtained from a polyol (PO) and a polycarboxylic acid (PC) which are similar to the polyester components of the above-described UMPE. The molecular weight of suitable PE is similar to that of the UMPE. Not only the unmodified polyester but also a polyester modified by a chemical bond other than a urea bond may be used as PE. For example, PE may be modified with an urethane bond. It is preferred that the UMPE and PE be compatible at least in part with each other for reasons of low fixation properties and anti-hot offset properties. Thus, the polyester component of the UMPE preferably has a composition similar to the PE. When a PE is used in conjunction with an UMPE, the weight ratio of the UMPE to the PE is generally 5:95 to 80:20, preferably 5:95 to 30:70, more preferably 5:95 to 25:75, most preferably 7:93 to 20:80. Too small an amount of the UMPE less than 5% by weight adversely affects the anti-hot offset properties of the resulting toner and poses a difficulty in simultaneously obtaining satisfactory low-temperature fixation properties and heat resistive preservability.

The PE preferably has a hydroxyl value of at least 5. The PE generally has an acid value (mgKOH/g) of 1–30, preferably 5–20. When the PE has an acid value, the resulting toner can be easily negatively charged and has improved compatibility between the toner and paper in the fixing step and improved low temperature fixation efficiency. When the acid value exceeds 30, however, charging stability, especially stability in environmental changes, is adversely affected. A variation of the acid value in the polyaddition reaction of the prepolymer (A) with the amine (B) results in a variation in the particle-forming step, which makes it difficult to control the emulsification.

In the present invention, the toner binder generally has a glass transition point (Tg) of 45–65° C., preferably 45–60° C. A glass transition point of less than 45° C. adversely affects the heat resistive preservability, while too high a glass transition point of over 65° C. causes insufficient low-temperature fixation efficiency.

As the colorant for use in the present invention, various conventionally known pigments can be used. Examples of such pigments include carbon black, Nigrosine dyes, iron black, Naphthol Yellow S, Hansa Yellow (10G, 5G and G), cadmium yellow, yellow colored iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow NCG), Vulcan Fast Yellow (5G and R), Tartrazine Lake, Quinoline Yellow Lake, Anthracene Yellow BGL, isoindolinone yellow, red iron oxide, red lead, orange lead, cadmium red, cadmium mercury red, antimony orange, Permanet Red 4R, Para Red, Fire Red, p-chloro-o-nitro aniline red, Lithol Fast Scarlet G, Brilliant Fast Scarlet, Brilliant Carmine BS, Permanent Red (F2R, F4R, FRL, FRLL and F4RH), Fast Scarlet VD, Vulkan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosine Lake, Rhodamine Lake B, Rhodamine Lake Y, Alizarine Lake, Thioindigo red B, Thioindigo Maroon, Oil Red, quinacridone red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue lake, metal-free Phthalocyanine Blue, Phthalocyanine Blue, Fast Sky Blue, Indanthrene Blue (RS, BC), indigo, ultramarine, prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone. These dyes and pigments can be used alone or in combination. The content of the colorant in the toner is preferably about 1–15% by weight, more preferably 3–10% by weight, based on the weight of the toner.

In the present invention, the colorant is preferably used in the form of master batch pigment particles composited with a resin as described previously.

As a binder resin to be kneaded with the colorant for preparation of the master batch, the above-described modified polyester or unmodified polyester may be used. Polymers that can be also used as the binder resin are homopolymers of styrene or substituted styrenes such as polystyrene, poly-p-chlorostyrene, and polyvinyltoluene; styrene-based copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene terpolymer, styrene-maleic acid copolymer, and styrene-maleate copolymer; polymethyl methacrylate, polybutyl methacrylate, polyvinyl chloride, polyvinyl acetate, polyethylene, polypropylene, polyester, epoxy resin, epoxy polyol resin, polyurethane, polyamide polyvinyl butyral, polyacrylic acid resin, rosin, modified rosin, terpene resin, aliphatic or alicyclic hydrocarbon resin, aromatic petroleum resin, chlorinated paraffin, and paraffin wax. These polymers can be used alone or in combination.

The master batch can be obtained by mixing and kneading a binder resin and a colorant while applying a large shearing force thereto in a suitable kneader such as a three roll mill. At this time, an organic solvent may be used to enhance the interaction between the resin and the colorant. A method called "flushing" method can be adopted to obtain the master batch, in which an aqueous paste containing a colorant is kneaded together with a binder resin and an organic solvent until the colorant migrates to the resin and then the organic solvent and water are removed. This method is preferable because a wet cake of the colorant can be used without drying.

The toner of the present invention preferably contains a releasing agent (wax) in addition to the toner binder and the colorant. Any wax may be suitably used for the purpose of the present invention. Preferred examples of the wax include polyolefin waxes such as polyethylene wax and polypropylene wax; long chain hydrocarbon waxes such as paraffin wax and sazole wax; and carbonyl group-containing waxes. Especially preferred is the use of a carbonyl group-containing wax. Illustrative of suitable carbonyl group-containing waxes are polyalkanoic acid esters such as carnauba wax, montan wax, trimethylolpropane tribehenate, pentaerythritol tetrabehenate, pentaerythritol diacetate dibehenate, glycerin tribehenate and 1,18-octadecanediol distearate; polyalkanol esters such as tristearyl trimellitate and distearyl maleate; polyalkanoic acid amides such as ethylenediamine dibehenyl amide; polyalkylamides such as trimellitic acid tristearyl amide; and dialkyl ketones such as distearyl ketone. Above all, the use of a polyalkanoic acid ester is preferred. The wax for use in the present invention generally has a melting point of 40–160° C., preferably 50–120° C., more preferably 60–90° C. A wax having a melting point of below 40° C. adversely affects the heat resistive preservability of the resulting toner, while a wax having a melting point of over 160° C. is apt to cause cold offset in fixation at a low temperature. Preferably, the wax has a melt viscosity of 5–1,000 cps, more preferably 10–100 cps, as measured at a temperature 20° C. higher than the melting point thereof. A wax having a melt viscosity of greater than 1,000 cps has little effect on improving the anti-hot offset properties and low-temperature fixation properties of a toner. The content of the wax in the toner is generally 1–40% by weight, preferably 3–30% by weight, based on the weight of the toner.

The toner of the present invention can contain a charge controlling agent if necessary. As the charge controlling agent, any charge controlling agent generally used in the field of toners for use in electrophotography may be used. Illustrative of suitable charge controlling agents are Nigrosine dyes, triphenyl methane dyes, chromium-containing metal complex dyes, molybdic acid chelate pigments, rhodamine dyes, alkoxyamines, quaternary ammonium salts including fluorine-modified quaternary ammonium salts, alkylamide, phosphorus and phosphorus compounds, tungsten and tungsten compounds, fluorine-containing activators, metallic salts of salicylic acid and metallic salts of salicylic acid derivatives.

Specific examples of the charge controlling agents include Bontron 03 (Nigrosine dye), Bontron P-51 (quaternary ammonium salt), Bontron S-34 (metal-containing azo dye), E-82 (oxynaphthoic acid type metal complex), E-84 (salicylic acid type metal complex), and E-89 (phenol type condensation product), which are manufactured by Orient Chemical Industries Co., Ltd.; TP-302 and TP-415 (quaternary ammonium salt molybdenum complex), and TN-105 (zirconium compound), which are manufactured by Hodogaya Chemical Co., Ltd.; Copy Charge PSY VP2038 (quaternary ammonium salt), Copy Blue PR (triphenylmethane derivative), Copy Charge NEG VP2036 and Copy Charge NX VP434 (quaternary ammonium salt), which are manufactured by Hoechst AG; LRA-901 and LR-147 (boron complex), which are manufactured by Japan Carlit Co.; copper Phthalocyanine; perylene; quinacridone; azo pigments; and polymer compounds having a functional group such as a sulfonic group, a carboxyl group or a quaternary ammonium salt group.

The amount of the charge controlling agent is determined in view of the kind of the binder resin, absence or presence of optional additives and the method (including a dispersing method) of preparing the toner and is not definitely limited, but is preferably 0.1–10 parts by weight, more preferably 0.2–5 parts by weight, per 100 parts by weight of the binder resin. When the amount exceeds 10 parts by weight, the charge amount of the toner is so large that the effect of the main charge controlling agent is reduced and the electrostatic attracting force relative to a developing roller is increased, resulting in a reduction of fluidity of the developer and in a reduction of the image density. The charge controlling agent and releasing agent may be melted and kneaded together with the master batch and the resin. Of course, these agents may be added at the time of dissolution or dispersion of the master batch and the resin.

Inorganic fine particles may be suitably used, as an external additive, to improve the fluidity, developing efficiency and charging properties of the colorant-containing toner particles obtained in the present invention. These inorganic fine particles preferably have a primary particle size of 5 mμ to 2 μm, more preferably 5 mμ to 500 mμ, and a BET specific surface area of 20–500 $m^2/g$. The inorganic fine particles are used in an amount of generally 0.01–5% by weight, preferably 0.01–2.0% by weight, based on the weight of the toner. Examples of the inorganic fine particles include silica, alumina, titanium oxide, barium titanate, magnesium titanate, calcium titanate, strontium titanate, zinc oxide, tin oxide, quartz sand, clay, mica, wallstonite, diatomaceous earth, chromium oxide, cerium oxide, iron oxide red, antimony trioxide, magnesium oxide, zirconium oxide, barium sulfate, barium carbonate, calcium carbonate, silicon carbide and silicon nitride.

The external additive may also be fine particles of a polymeric substance such as polystyrene, polymethacrylate or an acrylate copolymer obtained by soap-free emulsion polymerization, suspension polymerization or dispersion polymerization; silicone, benzoguanamine or nylon obtained by polycondensation; or a thermosetting resin.

By subjecting these external additives to a surface treatment to improve the hydrophobic properties thereof, deterioration of the fluidity and the charging properties of the toner can be avoided even under high humidity conditions. Suitable surface treating agents include silane coupling agents, silylating agents, silane coupling agents having a fluorinated alkyl group, organic titanate type coupling agents, aluminum type coupling agents, silicone oil and modified silicone oil.

A cleaning property improving agent may be also used in the toner of the present invention for facilitating the removal of toner remaining on a photoconductor or a primary transfer medium after transfer. Suitable examples of such a cleaning property improving agent include fatty acids and their metal salts such as stearic acid, zinc stearate and calcium stearate, and fine particles of a polymer prepared by, for example, soap-free emulsion polymerization such as polymethyl methacrylate fine particles and polystyrene fine particles. The particulate polymer preferably has a relatively has a relatively narrow particle size distribution, with a volume average particle size of 0.01–1 $\mu$m.

A method of preparing the toner according to the present invention will be next described in detail.

In the preparation of a toner according to the present invention, an oil dispersion which contains an isocyanate group-containing polyester prepolymer (A) dissolved in an organic solvent, a pigment colorant dispersed therein and a releasing agent dissolved or dispersed therein is first prepared in a oil dispersion preparation step.

The oil dispersion is subjected to a pulverizing treatment using a wet pulverizing device in a wet pulverizing step to finely pulverize and uniformly disperse the colorant contained therein. In this case, the pulverization treatment is carried out for 30 to 120 minutes.

The thus obtained oil dispersion is then dispersed (emulsified) in an aqueous medium in the presence of inorganic fine particles and/or polymer fine particles in a dispersing (emulsifying) step to form an oil-in-water dispersion (emulsion). The isocyanate group-containing polyester prepolymer (A) contained in the dispersion is then reacted with an amine (B) in a reaction step to form an urea-modified polyester resin (C) having an urea group.

As the organic solvent is one which can dissolve a polyester resin and which is insoluble, hard to be soluble or only slightly soluble in water. The solvent generally has a boiling point of 60 to 150° C., preferably 70 to 120° C. Examples of the solvent include ethyl acetate and methyl ethyl ketone.

In the present invention, it is preferred that the above-described master batch coloring agent particles be used as the colorant for reasons of capability of efficiently preparing a uniform dispersion of the colorant.

In the present invention, it is preferred that a polyester resin (D) which is not reactive with an amine be dissolved in the organic solvent as an additive component. The polyester resin (D) may be dispersed in the aqueous medium.

In the present invention, dispersion into the aqueous medium may be carried out using any desired dispersing device, such as a low speed shearing type dispersing device, a high speed shearing type dispersing device, an abrasion type dispersing device, a high pressure jet type dispersing device or an ultrasonic-type dispersing device. A high speed shearing type dispersing device is preferably used for reasons of obtaining dispersed toner particles having a diameter of 2–20 $\mu$m. The high speed shearing type dispersing device is generally operated at a revolution speed of 1,000–30,000 rpm, preferably 5,000–20,000 rpm. The dispersing time is generally 0.1 to 5 minutes in the case of a batch type dispersing device. The dispersing step is generally performed at 0–150° C. (under a pressurized condition), preferably 40–98° C. A higher temperature is suitably used to decrease the viscosity of the mass and facilitate the dispersion.

The aqueous medium is generally used in an amount of 50–2,000 parts by weight, preferably 100–1,000 parts by weight per 100 parts by weight of the solid matters of the toner, such as the polyester (A), colorant, releasing agent and polyester resin (D). When the amount of the aqueous medium is less than 50 parts by weight, the solid matters of the toner are not properly dispersed therein so that toner particles having a desired particle size are not obtainable. An amount of the aqueous medium in excess of 2,000 parts by weight is not economical. A dispersing agent may be used, if necessary. The use of the dispersing agent is preferable for reasons of attainment of stabilization of the dispersion and sharp particle size distribution.

The aqueous medium for use in the present invention may be water by itself or a mixture of water with a water-miscible solvent such as an alcohol, e.g. methanol, isopropanol or ethylene glycol; dimethylformamide; tetrahydrofuran; cellosolve, e.g. methyl cellosolve; or a lower ketone, e.g. acetone or methyl ethyl ketone.

As a dispersing agents for emulsifying and dispersing an oil phase in which solid matters of the toner are dispersed into a water-containing liquid (aqueous medium) various surfactants (emulsifying agents) may be used. Examples of the dispersing agent include anionic surfactants such as alkylbenzenesulfonate, a-olefin sulfonate, and phosphate; cationic surfactants such as amine salt surfactants, e.g. an alkylamine salt, aminoalcohol fatty acid derivatives, polyamine fatty acid derivatives and imidazoline; and quaternary ammonium salt surfactants, e.g. alkyl trimethylammonium salt, dialkyl dimethylammonium salt, alkyl dimethylbenzylammonium salt, pyridinium salt, alkyl isoquinolinium salt and benzethonium chloride; nonionic surfactants such as fatty acid amide derivatives and polyhydric alcohol derivatives; and ampholytic surfactants such as alanine, dodecyl di(aminoethyl)glycine, di(octylaminoethyl)glycine and N-alkyl-N,N-dimethylammonium betaine.

In the present invention, a surfactant having a fluoroalkyl group can exert its effects in a very small amount. Suitable anionic surfactants having a fluoroalkyl group include fluoroalkylcarboxylic acids having 2–10 carbon atoms and their metal salts, disodium perfluorooctanesulfonylglutamate, sodium 3-[omega-fluoroalkyl($C_6$–$C_{11}$)oxy]-1-alkyl ($C_3$–$C_4$) sulfonate, sodium 3-[omega-fluoroalkanoyl ($C_6$–$C_8$)-N-ethylamino]-1-propanesulfonate, fluoroalkyl($C_{11}$–$C_{20}$) carboxylic acids and their metal salts, perfluoroalkylcarboxylic acids ($C_7$–$C_{13}$) and their metal salts, perfluoroalkyl ($C_4$–$C_{12}$)sulfonic acids and their metal salts, perfluorooctanesulfonic acid diethanolamide, N-propyl-N-(2-hydroxyethyl)perfluorooctanesulfonamide, perfluoroalkyl($C_6$–$C_{10}$)sulfoneamidopropyl trimethylammonium salts, perfluoroalkyl ($C_6$–$C_{10}$)-N-ethylsulfonylglycine salts, and monoperfluoroalkyl($C_6$–$C_{16}$) ethylphosphoates.

Examples of tradenames of anionic surfactants include Surflon S-111, S-112 and S-113 (manufactured by Asahi Glass Co., Ltd.), Florard FC-93, FC-95, FC-98 and FC-129 (manufactured by Sumitomo 3M Ltd.), Unidine DS-101 and DS-102 (manufactured by Daikin Industries Ltd.), Megafac F-110, F-120, F-113, F-191, F-812 and F-833 (manufactured by Dainippon Ink and Chemicals, Inc.), Ektop EF-102, 103, 104, 105, 112, 123A, 123B, 306A, 501, 201 and 204 (manufactured by Tochem Products Co., Ltd.), and Phthargent F-100 and F-150 (manufactured by Neos Co., Ltd.).

Examples of cationic surfactants include primary, secondary or tertiary aliphatic amine acids; aliphatic quaternary ammonium salts such as perfluoroalkyl($C_6$–$C_{10}$) sulfonamidopropyltrimethyl-ammonium salts; benzalkonium salts; benzethonium chloride; pyridinium salts; and imidazolinium salts. Tradenamed cationic surfactants include Surflon S-121 (Asahi Glass Co., Ltd.), Florard FC-135 (manufactured by Sumitomo 3M Ltd.), Unidine DS-202 (manufactured by Daikin Industries Ltd.), Megafac F-150 and F-824 (Dainippon Ink and Chemicals Inc.), Ektop EF-132 (manufactured by Tochem Products Co., Ltd.), and Phthargent F-300 (manufactured by Neos Co., Ltd.).

As inorganic fine particles which can be present in the aqueous medium, there may be used various inorganic compounds, which are insoluble or hardly soluble in water. Examples of the inorganic compound include tricalcium phosphate, calcium carbonate, titanium oxide, colloidal silica and hydroxyapatite.

As polymer fine particles which can be present in the aqueous medium, there may be used various conventionally used polymers which are insoluble or hardly soluble in water. Examples of the polymer fine particles include those of hydrophobic polymers such as a hydrocarbon resin, a fluorine-containing resin and a silicone resin.

The fine particles generally have a smaller particle size than the toner particles. From the standpoint of uniformity of particle size, it is preferred that the ratio of the volume average particle size of the fine particles to the volume average particle size of the toner be in the range of 0.001 to 0.3. When the particle size ratio is greater than 0.3, the fine particles do not well adhere to the surfaces of the toner particles and the resulting toner tends to have a wide particle size distribution.

The volume average particle size of the fine particles can be adequately controlled within the above range to obtain a toner having a desired particle size. For example, when a toner having a volume average particle size of 5 $\mu$m is desired, the volume average particle size of the fine particles is preferably controlled to fall in the range of 0.0025–1.5 $\mu$m, more preferably in the range of 0.005–1.0 $\mu$m. When a toner having a volume average particle size of 10 $\mu$m is desired, the volume average particle size of the fine particles is preferably controlled to fall in the range of 0.005–3 $\mu$m, more preferably in a range of 0.05–2 $\mu$m.

In the present invention, a hydrophylic high molecular weight substance capable of forming a polymeric protective colloid may be incorporated into the aqueous medium as a dispersion stabilizing agent. Examples of monomer components constituting such a high molecular weight substance include unsaturated carboxylic acids such as acrylic acid, methacrylic acid, α-cyanoacrylic acid, α-cyanomethacrylic acid, itaconic acid, crotonic acid, fumaric acid, maleic acid and maleic anhydride; unsaturated carboxylic acid esters such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate and glycerin monomethacrylate; unsaturated carboxylic acid amides such as N-methylolacrylamide and N-methylolmethacrylamide; vinyl ethers such as vinylmethyl ether, vinylethyl ether and vinylpropyl ether; vinyl esters of carboxylic acids such as vinyl acetate, vinyl propionate and vinyl butyrate; acrylamide, methacrylamide, diacetone acrylamide and methylol compounds thereof; acid chlorides such as acrylic acid chloride and methacrylic acid chloride; nitrogen-containing or heterocycle-containing vinyl monomers such as vinyl pyridine, vinyl pyrrolidone, vinyl imidazole and ethyleneimine.

Other high molecular weight substances suitably used in the present invention polyoxyethylene compounds such as polyoxyethylene, polyoxypropylene, polyoxyethylene alkyl amine, polyoxypropylene alkyl amine, polyoxyethylene alkyl amide, polyoxypropylene alkyl amide, polyoxyethylene nonyl phenyl ether, polyoxyethylene lauryl phenyl ether, polyoxyethylene stearyl phenyl ester and polyoxyethylene nonyl phenyl ester; and cellulose derivatives such as methyl cellulose, hydroxyethyl cellulose and hydroxypropyl cellulose.

In the present invention, the removal of the liquid medium from an emulsified dispersed liquid obtained after the polyaddition of the prepolymer (A) with the amine (B) is carried out in a liquid medium removing step in which the temperature of the whole system is gradually raised to evaporate the organic solvents. In this case, the sphericity of the toner can be controlled by the strength of the agitation of liquid prior to the removal of the organic solvents as well as the time for removing the organic solvent. When the removal of the solvent is slowly performed, the shape becomes near to the true sphere and the sphericity increases 0.980 or greater. When the agitation is performed vigorously and the removal of the solvent is performed within a short period of time, the shape becomes uneven and irregular and the sphericity decreases to 0.900 to 0.950. When the emulsified liquid, obtained after the reaction of the liquid which has been emulsified and dispersed in the aqueous medium, is stirred with a strong agitation force at a temperature of 30 to 50° C. in a stirring tank during the liquid removal operation, it is possible to control the sphericity in a range of 0.850 to 0.990. Such a sphericity control is considered to be attained by occurrence of volume shrinkage during formation of particles due to abrupt removal of organic solvents such as ethyl acetate contained therein.

The removal of the liquid medium from the resulting emulsified dispersion can be carried out by spraying the emulsified dispersed liquid into a dry atmosphere to remove the organic solvent to obtain fine toner particles and by removing, by evaporation, the aqueous dispersing agent. The dry atmosphere into which the dispersion is sprayed may be a heated gas, such as air, nitrogen, carbon dioxide or combustion gas, preferably a gas flow heated above the boiling point of the organic solvent having the highest boiling point in the solvents used. A short-time treatment with a spray drier, a belt drier or a rotary kiln can provide toner particles with high quality. The time to complete the removal of the solvent from the dispersed liquid after the reaction is preferably short and is generally within 25 hours.

When a dispersing agent, such as calcium phosphate, capable of being dissolved in an acid or an alkali is used as the inorganic fine particles, washing with an acid such as hydrochloric acid and then with water can remove the inorganic fine particles from the toner. An enzyme can be also used to decompose the dispersing agent. When the dispersing agent is used, it is possible to permit the dispersing agent to remain on surfaces of the toner particles. However, the dispersing agent is preferably removed by washing after the reaction of the prepolymer (A) with the amine (B) in view of the charging characteristics of the toner.

In addition, a solvent capable of dissolving the urea-modified polyester and the prepolymer is preferably incorporated into the aqueous medium to lower the viscosity of the dispersed liquid after the reaction. The use of such a solvent can produce toner particles having a narrow particle size distribution. A volatile solvent having a boiling point of lower than 100° C. is preferred since it is easy to remove. Examples of the solvent include toluene, xylene benzene, carbon tetrachloride, methylene chloride, 1,2-dichloroethane, 1,1,2-trichloroethane, trichloroethylene, chloroform, monochlorobenzene, dichlorloethylidene, methyl acetate, ethyl acetate, methyl ethyl ketone, and methyl isobutyl ketone. These solvents may be used alone or in combination. Especially preferred is the use of an aromatic solvent such as toluene or xylene, or a halogenated hydrocarbon such as methylene chloride, 1,2-dichloroethane, chloroform or carbon tetrachloride. The solvent is generally used in an amount of 0–300 parts by weight, preferably 0–100 parts by weight, more preferably 25–70 parts by weight, per 100 parts by weight of the prepolymer (A). The solvent, when used, is removed by heating under ambient or a reduced pressure after the reaction of the prepolymer (A) with the amine (B).

The time of the reaction of the prepolymer (A) with the amine (B) is generally 10 minutes to 40 hours, preferably 2–24 hours, although it depends on the reactivity of the isocyanate groups in the prepolymer (A) with the amines (B). The reaction temperature is generally 0–150° C., preferably 40–98° C. When desired, a known catalyst such as dibutyltin laurate or dioctyltin laurate may be used.

When the toner particles in the dispersion obtained after the reaction of the prepolymer (A) with the amine (B) have a wide particle size distribution and when the washing and drying treatment was performed with the particle distribution, classification may be conducted to adjust the particle size distribution. Classification may be carried out in such a manner that a fine particle fraction in the liquid is removed by using, for example, a cyclone, a decanter or a centrifugal device. The classification for the removal of excessively fine particles is preferably carried out in the liquid for reasons of efficiency, although the classification may be conducted as a powder after the drying of the particles. Unnecessary large and fine particles thus separated may be recycled to the kneading step and reused for the preparation of particles. At this time, the large and small particles may be in a wet state.

The dispersing agent used is preferably removed as much as possible, preferably simultaneously with the classification.

The toner particles after drying are optionally mixed with different types of particles such as a particulate releasing agent, a particulate charge controlling agent and a particulate fluidizing agent. In this case, by applying a mechanical force to the mixed powder, these particles can be fixed and coalesce on the surfaces of the toner particles and prevented from separating from the resulting composite particles.

As specific means, there may be mentioned a method in which the mixture is imparted with impact forces by rapidly rotating blades; and a method in which the mixture is charged into a high speed airflow so that the particles of the mixture accelerate and collide with each other or the composited particles are brought into collision against a proper collision plate. Specific examples of such apparatuses include an Ong Mill (manufactured by Hosokawa Micron Co., Ltd.), modified I type Mill in which pressure of air for pulverization is reduced (manufactured by Nippon Pneumatic Co., Ltd.), Hybridization System (manufactured by Nara Machine Co., Ltd.), Kryptron System (manufactured by Kawasaki Heavy Industries, Ltd.), and automatic mortars.

The toner of the present invention can be used as a two-component developer after mixed with a magnetic carrier. The content of the toner in the developer is preferably 1–10 parts by weight per 100 parts by weight of the carrier. Any conventionally-known magnetic carrier, such as iron powder, ferrite powder, magnetite powder, magnetic resin carrier, can be used. Illustrative of resins for covering the surface of the carrier include amino resin, urea-formaldehyde resin, melamine resin, benzoguanamine resin, urea resin, polyamide resin and epoxy resin. Also usable for covering a carrier are polyvinyl or polyvinylidene resins; polystyrene resins such as acrylic resin, polymethyl methacrylate resin, polyacrylonitrile resin, polyvinyl acetate resin, polyvinyl alcohol resin, polyvinyl butyral resin, polystyrene resin and styrene-acrylic copolymer; halogenated olefin resins such as polyvinyl chloride resin; polyester resins such as polyethylene terephthalate resin and polybutylene terephthalate resin; polycarbonate resins; polyethylene resins; polyvinyl fluoride resins; polyvinylidene fluoride resins; polytrifluoroethylene resins; polyhesafluoropropylene resins; copolymers of vinylidene fluoride and an acrylic monomer; copolymers of vinylidene fluoride and vinyl fluoride; terpolymers of tetrafluoroethylene, vinylidene fluoride and a fluorine-free monomer; and silicone resins. The resin coating for the carrier may contain conductive powder such as metal powder, carbon black, titanium oxide, tin oxide or zinc oxide. The conductive powder preferably has an average particle size of 1 $\mu$m or less since, when the average particle diameter exceeds 1 $\mu$m, it is difficult to control the electric resistance. The toner of the present invention may be used as a one-component magnetic or nonmagnetic toner without no carrier.

EXAMPLES

The present invention will be further described below with reference to examples but is not limited thereto. Parts are by weight. Toners used in the examples are shown in Table 1.

Example 1

Preparation Example of Polyester as Additive:

690 Parts of an ethylene oxide (2 mole) adduct of bisphenol A and 230 parts of terephthalic acid were charged in a reaction vessel equipped with a condenser, a stirrer and a nitrogen gas feed pipe, and reacted at 210° C. under ambient pressure for 10 hours. The reaction was further continued for 5 hours at a reduced pressure of 10–15 mmHg. After cooling the temperature to 160° C., 18 parts of phthalic anhydride were added to the reaction vessel and the mixture was reacted for 2 hours, thereby obtaining an unmodified polyester (a) having a weight average molecular weight of 85,000.

Preparation Example of Prepolymer:

800 Parts of an ethylene oxide (2 mole) adduct of bisphenol A, 160 parts of isophthalic acid, 60 parts of terephthalic acid and 2 parts of dibutyltin oxide were charged in a reaction vessel equipped with a condenser, a stirrer and a nitrogen gas feed pipe, and reacted at 230° C. under ambient pressure for 8 hours. The reaction was further continued for 5 hours at a reduced pressure of 10–15 mmHg. After cooling to 160° C., 32 parts of phthalic anhydride were added to the reaction vessel and the mixture was reacted for 2 hours. Then the reaction mixture was cooled to 80° C. and reacted with 170 parts of isophorone diisocyanate in ethyl acetate for 2 hours, thereby obtaining an isocyanate group-containing prepolymer (1) having Mw of 35,000.

Synthesis of Ketimine:

30 Parts of isophorone diamine and 70 parts of methyl ethyl ketone were charged in a reaction vessel equipped with a stirrer and a thermometer and reacted at 50° C. for 5 hours to obtain a ketimine compound (1).

Preparation of Toner:

14.3 Parts of the above prepolymer (1), 55 parts of the polyester (a) and 78.6 parts of ethyl acetate were placed in a beaker and were stirred for dissolution, to which 10 parts of rice wax (melting point: 83° C.) as a releasing agent and 4 parts of copper phthalocyanin blue pigment were added and stirred at 40° C. for 5 minutes with a TK-type homomixer at 12,000 rpm. This was further subjected to a pulverization treatment at 20° C. for 30 minutes with a bead mill, thereby obtaining an oil dispersion (1) of toner materials.

306 Parts of ion-exchanged water, 265 parts of a 10% dispersion of tricalcium phosphate and 0.2 part of sodium dodecylbenzenesulfonate were placed in a beaker and were stirred with a TK-type homomixer at 12,000 rpm to form an aqueous dispersion (1). With stirring, the above oil dispersion (1) of toner materials and 2.7 parts of the ketimine compound (1) were added to the aqueous dispersion (1) to effect urea-forming reaction.

After the reaction, the dispersion (viscosity: 3,500 P·s) was subjected to an organic solvent removal treatment at 50° C. or less for 1.0 hour or less under a reduced pressure, followed by filtration, washing, drying and air classification, thereby obtaining spherical toner mother particles (1).

Next, 100 parts of the thus obtained mother particles (1) and 0.25 part of a charge controlling agent (Bontron E-84; manufactured by Orient Chemical Industries Co., Ltd.) were in a Q-type mixer (manufactured by Mitsui Mining Co., Ltd.) and were subjected to a mixing treatment at a turbine blade peripheral speed of 50 m/sec. The mixing was performed 5 cycles each including 2 minute mixing and 1 minute pause (thus, mixing time was 10 minutes in total).

This was further mixed with 0.5 part of hydrophobic silica (H2000 manufactured by Clariant Japan Inc.). The mixing was performed at a peripheral speed of 15 m/sec and 5 cycles each including 30 second mixing and 1 minute pause, thereby obtaining a cyan toner (1). The average dispersion diameter of the pigment colorant was 0.4 μm. Particles of the pigment having a particle diameter of 0.7 μm or more accounted for 3.5% by number. The properties and results of evaluation of the toner are shown in Tables 1 and 2.

Example 2

Preparation of Magenta Master Batch:

600 Parts of water and 200 parts of Pigment Red 57 (water-containing cake, solid content: 50%) were stirred with a flusher, to which 1,200 parts of a polyester resin (acid value: 3; hydroxyl value: 25; Mn: 3,500; Mw/Mn: 4.0; Tg: 60° C.) were added and kneaded at 150° C. for 30 minutes. This was mixed with 1,000 parts of xylene and then kneaded for 1 hour. After the removal of water and xylene, the kneaded mixture was rolled and cooled, pulverized with a pulverizer and passed twice through three-roll mill, thereby obtaining a magenta master batch pigment (MB1-M) having an average particle diameter of about 0.2 μm.

Preparation of Prepolymer:

856 Parts of an ethylene oxide (2 mole) adduct of bisphenol A, 200 parts of isophthalic acid, 20 parts of terephthalic acid and 4 parts of dibutyltin oxide were charged in a reaction vessel equipped with a condenser, a stirrer and a nitrogen gas feed pipe, and reacted at 250° C. under ambient pressure for 6 hours. The reaction was further continued for 5 hours at a reduced pressure of 50–100 mmHg. After cooling to 160° C., 18 parts of phthalic anhydride were added to the reaction vessel and the mixture was reacted for 2 hours. Then the reaction mixture was cooled to 80° C. and reacted with 170 parts of isophorone diisocyanate in ethyl acetate for 2 hours, thereby obtaining an isocyanate group-containing prepolymer (2) having Mw of 25,000.

Preparation of Toner:

15.4 Parts of the above prepolymer (2), 50 parts of the polyester (a) and 95.2 parts of ethyl acetate were placed in a beaker and were stirred for dissolution, to which 10 parts of carnauba wax (molecular weight: 1,800; acid value: 2.5; needle penetration degree: 1.5 mm/40° C.) and 10 parts of the above master batch particles described in Example 2 were added and stirred at 85° C. with a TK-type homomixer at 10,000 rpm. This was further subjected to a wet pulverization treatment using a bead mill in the same manner as described in Example 1, thereby obtaining an oil dispersion (2) of toner materials.

Next, spherical toner mother particles (2) were prepared in the same manner as described in Example 1 using the oil dispersion obtained above.

Next, a toner (2) was prepared in the same manner as described in Example 1 except that Bontron E-89 (manufactured by Orient Chemical Industries Co., Ltd.) was substituted for Bontron E-84 as a charge controlling agent. The average dispersion diameter of the pigment colorant of this toner was 0.25 μm. Particles of the pigment having a particle diameter of 0.5 μm or more accounted for 1.0% by number. The properties and results of evaluation of the toner are shown in Tables 1 and 2.

Example 3

Preparation of Prepolymer:

755 Parts of an ethylene oxide (2 mole) adduct of bisphenol A, 195 parts of isophthalic acid, 15 parts of terephthalic acid and 4 parts of dibutyltin oxide were charged in a reaction vessel equipped with a condenser, a stirrer and a nitrogen gas feed pipe, and reacted at 220° C. under ambient pressure for 8 hours. The reaction was further continued for 5 hours at a reduced pressure of 50–100 mmHg. After cooling to 160° C., 10 parts of phthalic anhydride were added to the reaction vessel and the mixture was reacted for 2 hours. Then the reaction mixture was cooled to 80° C. and reacted with 170 parts of isophorone diisocyanate in ethyl acetate for 2 hours, thereby obtaining an isocyanate group-containing prepolymer (3) having Mw of 25,000.

Preparation of Toner:

15.4 Parts of the above prepolymer (3), 50 parts of the polyester (a) and 95.2 parts of ethyl acetate were placed in a beaker and were stirred for dissolution, to which 10 parts of carnauba wax (molecular weight: 1,800; acid value: 2.5; needle penetration degree: 1.5 mm/40° C.) and 15 parts of the master batch particles described in Example 2 were added and stirred at 85° C. with a TK-type homomixer at 14,000 rpm. This was further subjected to a wet pulverization treatment in the same manner as described in Example 1 using a bead mill, thereby obtaining an oil dispersion (3) of toner materials.

465 Parts of ion-exchanged water, 245 parts of a 10% dispersion of sodium carbonate and 0.4 part of sodium dodecylbenzenesulfonate were placed in a beaker and were stirred to form an aqueous dispersion (3). The aqueous dispersion (3) was heated to 40° C. and, while stirring with a TK-type homomixer at 12,000 rpm, the above oil dispersion (3) of toner materials was added. After the mixture was stirred for 10 minutes, 2.7 parts of the ketimine compound (1) were added thereto to effect reaction thereof Next, the resulting mixture was filtered, washed and dried in the same manner as described in Example 2 to obtain spherical toner mother particles (3).

Next, a toner (3) was prepared in the same manner as described in Example 1 using the toner mother particles (3). The average dispersion diameter of the pigment colorant of this toner was 0.15 μm. Particles of the pigment having a particle diameter of 0.5 μm or more accounted for 3.0% by number. The properties and results of evaluation of the toner are shown in Tables 1 and 2.

COMPARATIVE EXAMPLE 1

Preparation of Toner Binder:

354 Parts of an ethylene oxide (2 mole) adduct of bisphenol A and 166 parts of isophthalic acid were subjected to polycondensation using 2 parts of dibutyltin oxide as a catalyst to obtain a comparative toner binder (11) having Tg of 57° C.

Preparation of Toner:

100 Parts of the above toner binder (11), 200 parts of ethyl acetate, 4 parts of copper phthalocyanin blue pigment and 5 parts of rice was as used in Example 1 were placed in a beaker and were stirred at 50° C. with a TK-type homomixer at 12,000 rpm to obtain a dispersion (11). Next, a comparative toner (11) having a volume average particle was prepared in the same manner as described in Example 1 except that the dispersion (11) was used. The average dispersion diameter of the pigment colorant of this toner was 0.70 μm. Particles of the pigment having a particle diameter of 0.7 μm or more accounted for 35% by number. The properties and results of evaluation of the toner are shown in Tables 1 and 2.

COMPARATIVE EXAMPLE 2

Preparation of Toner Binder:

343 Parts of an ethylene oxide (2 mole) adduct of bisphenol A, 166 parts of isophthalic acid and 2 parts of dibutyltin oxide were charged in a reaction vessel equipped with a condenser, a stirrer and a nitrogen gas feed pipe, and reacted at 230° C. under ambient pressure for 8 hours. The reaction was further continued for 5 hours at a reduced pressure of 10–15 mmHg. After cooling to 80° C., 14 parts of isophorone diisocyanate in toluene were added to the reaction vessel and the mixture was reacted at 110° C. for 5 hours. From the reaction mixture was removed the solvent to leave an urethane-modified polyester having a peak top molecular weight of 7,000. 363 Parts of an ethylene oxide (2 mole) adduct of bisphenol A and 166 parts of isophthalic acid were subjected to polycondensation in the same manner as that in Example 1 to obtain an unmodified polyester having a peak molecular weight of 3,800 and an acid value of 7. 350 Parts of the urethane-modified polyester and 650 parts of the unmodified polyester were dissolved in toluene. After mixing, the solvent was removed to obtain a comparative toner binder (12) having Tg of 58° C.

Preparation of Toner:

Using 100 parts of the comparative toner binder (12), 10 parts of each of the master batch and carnauba wax used in Example 2, a toner was prepared as follows. First, the above components were mixed using a Henschel mixer and then kneaded using a continuous-type kneader. The kneaded product was finely pulverized using a jet pulverizing machine and air-classified to obtain toner particles having a volume average particle diameter of 6 μm. The toner particles (100 parts) were then mixed with 0.5 part of hydrophobic silica and 0.5 part of hydrophobic titanium oxide using a Henschel mixer to obtain a comparative toner (12). The average dispersion diameter of the pigment colorant of this toner was 0.7 μm. Particles of the pigment having a particle diameter of 0.5 μm or more accounted for 15% by number. The properties and results of evaluation of the toner are shown in Tables 1 and 2.

TABLE 1

| Toner | Property of Toner Binder | | |
|---|---|---|---|
| No. | Peak Molecular Weight | Acid Value | Tg |
| 1 | 4,000 | 10 | 55 |
| 2 | 5,200 | 8 | 60 |
| 3 | 4,500 | 15 | 62 |
| 4 | 6,000 | 4 | 52 |
| 11 | 8,000 | 7 | 57 |
| 12 | 7,000 | 7 | 58 |

TABLE 2

| Toner No. | 1 | 2 | 3 | 4 | 11 | 12 |
|---|---|---|---|---|---|---|
| Dv | 5.5 | 6.8 | 4.9 | 6.9 | 6 | 7.5 |
| Dn | 4.8 | 6.2 | 4.2 | 6.2 | 4.6 | 6.1 |
| Dv/Dn | 1.15 | 1.1 | 1.17 | 1.11 | 1.3 | 1.22 |
| Sphericity | 0.94 | 0.95 | 0.93 | 0.955 | 0.97 | 0.925 |
| Fluidity | 0.3 | 0.35 | 0.44 | 0.4 | 0.25 | 0.23 |
| Low Temperature Fixability (° C.) | 150 | 150 | 160 | 140 | 155 | 160 |
| Hot-offset Property (° C.) | 220 | 220 | 230 | 220 | 200 | 180 |
| Gloss (° C.) | 160 | 150 | 160 | 160 | 160 | 150 |
| Haze | Δ | ○ | ○ | ○ | Δ | Δ |
| Pigment Diameter (μm) | 0.4 | 0.25 | 0.15 | 0.15 | 0.7 | 0.7 |
| Content of Pigment Having Particle Diameter of at least 0.7 μm (%) | 3.5 | 1 | 2 | 3 | 35 | 15 |

Evaluation Method:

(1) Method of Measurement of Tg

A method of measuring Tg will be described. As a device for measuring Tg, TG-DSC system TAS-100 manufactured by Rigaku Denki Co., Ltd. was used. About 10 mg of a sample was placed in an aluminum sample vessel. The vessel was place on a holder unit, which was then set in an electric furnace. The sample was heated from room temperature to 150° C. at a heating speed of 10° C./min. After having been allowed to stand at 150° C. for 10 minutes, the sample was cooled to room temperature and allowed to stand at that temperature for 10 minutes. In a nitrogen flow, DSC measurement was carried out while heating the sample again to 150° C. at a heating speed of 10° C./min. Tg was determined using the analyzing system of the TAS-100 system as a temperature at the intersection of the base line and a tangentially extrapolated line on the endothermic peak.

(2) Method of Measurement of Acid Value

The acid value was measured by a method according to JIS K0070. When the sample was not able to be dissolved, dioxane or tetrahydrofuran was used.

(3) Powder Fluidity

The apparent density (g/ml) was measured using a powder tester (manufactured by Hosokawa Micron Co., Ltd.). The better the fluidity of the toner, the higher is the apparent density. Evaluation was made based on the following four ranks.

Poor (X): less than 0.25

Fair (Δ): 0.25–0.30

Good (○): 0.30–0.35

Excellent (◎): 0.35 or more (4) Minimum Fixation Temperature

Copies were formed on papers (Type 6200 manufactured by Ricoh Company, Ltd.) using a modified copying machine (MF-200 manufactured by Ricoh Company, Ltd.) having a fixing roll made of a tetrafluoroethylene resin. The fixation temperature was measured in terms of the minimum temperature of the fixing roll at which the residual rate of the image density was 70% or more when the fixed image was rubbed with a pat.

(5) Temperature Causing Hot offset (HOT)

Image fixation was performed in the same manner as that in the above minimum fixation temperature measurement. Occurrence of hot offsetting was determined with naked eyes. Hot offset was evaluated in terms of the temperature of the fixing roll at which hot offset occurred.

(6) Gloss

Gloss was evaluated in terms of the temperature of the fixing roll of a color copying machine (PRETER 550 manufactured by Ricoh Company, Ltd.) at which gloss-developing temperature at the 60 degree glossiness of the fixed image was 10% or more.

(7) Haze

Measured by direct reading haze computer (Model HGM-2DP).

The toner according to the present invention can provide images having high quality and high fineness and can exhibit both low temperature fixability and anti-hot offsetting property. The images are excellent in transparency and in chroma. A full color mage formed on an OHP paper has sufficient transparency. The toner of the present invention is excellent in charge stability and color reproducibility.

What is claimed is:

1. An electrophotographic toner obtained by dispersing an oil dispersion, containing an isocyanate group-containing polyester prepolymer dissolved in an organic solvent, a pigment colorant dispersed therein and a releasing agent dissolved or dispersed therein, in an aqueous medium in the presence of inorganic fine particles and/or polymer fine particles, reacting said prepolymer in said dispersion with a polyamine and/or a monoamine containing an active hydrogen-containing group to form an urea-modified polyester resin having an urea group, and by removing the liquid medium from the dispersion containing the urea-modified polyester resin, characterized in that said pigment colorant contained in the toner has a dispersion diameter, in terms of a number average diameter, of 0.5 μm or less and in that particles of said pigment colorant having a diameter of 0.7 μm or more account for 5% by number or less.

2. A toner as recited in claim 1, characterized in that said pigment colorant has a dispersion diameter, in terms of a number average diameter, of 0.3 μm or less and in that particles of said pigment colorant having a diameter of 0.5 μm or more account for 10% by number or less.

3. A toner as recited in claim 1, wherein the toner has a weight average particle diameter of 3.0 to 7.0 μm and such a particle diameter distribution, that the ratio Dv/Dn (Dv: a volume average particle diameter, Dn: a number average particle diameter) is not smaller than 1.00 but not greater than 1.20.

4. A toner as recited in claim 1, wherein the toner has a sphericity of 0.900 to 0.960.

5. A toner as recited in claim 1, wherein the urea-modified polyester resin has a tetrahydrofuran soluble fraction that has such a molecular weight distribution that a main peak is present in a molecular weight region of 2,500 to 10,000 and that the number average molecular weight thereof is in the range of 2,500 to 500,000.

6. A toner as recited in claim 1, wherein the polyester resin contained in the toner has a glass transition temperature of 40 to 65° C. and an acid value of 1 to 30 mgKOH/g.

7. A toner as recited in claim 1, wherein said oil dispersion comprises a polyester resin dissolved therein and being non-reactive with said amine.

8. A developer comprising the toner as recited in claim claim 1, and a carrier.

9. A toner container comprising packed therein a toner as recited in claim 1.

10. A developer container characterized in that the container comprises packed therein a developer as recited in claim 8.

11. In a developing method comprising the step of developing an electrostatic latent image formed on a photoconductor using a developer comprising a toner, the improvement wherein the toner is a toner as recited in claim 1.

12. In a developing device comprising a photoconductor on which a latent image is formed and a developer for developing said latent image, the improvement wherein said developer comprises a toner as claimed in claim 1.

13. In a developing device comprising a photoconductor on which a latent image is formed and a developer for developing said latent image, the improvement wherein said developer comprises the toner contained in the toner container as claimed in claim 9.

14. In a developing device comprising a photoconductor on which a latent image is formed and a developer for developing said latent image, the improvement wherein said developer comprises the developer contained in the developer container as claimed in claim 10.

* * * * *